United States Patent [19]

Gilman

[11] 4,400,673

[45] Aug. 23, 1983

[54] THERMAL SWITCH HOUSING

[75] Inventor: Lester J. Gilman, Southampton, Pa.

[73] Assignee: Kiddo Consumer Durables Corporation, Bala Cynwyd, Pa.

[21] Appl. No.: 333,225

[22] Filed: Dec. 21, 1981

[51] Int. Cl.[3] ..... H01H 37/04

[52] U.S. Cl. ..... 337/380; 315/119; 315/309

[58] Field of Search ..... 337/22, 26, 27, 298, 337/414, 380; 315/118, 119, 309

[56] References Cited

U.S. PATENT DOCUMENTS

| | | | |
|---|---|---|---|
| 822,336 | 6/1906 | Armor | 315/116 |
| 2,037,058 | 4/1936 | Beltz | 315/224 |
| 2,098,507 | 11/1937 | Meginniss | 362/21 |
| 2,101,135 | 12/1937 | Finch et al. | 219/209 |
| 2,367,639 | 1/1945 | Conboy | 337/404 |
| 2,762,889 | 9/1956 | Waller | 337/413 |
| 2,907,871 | 10/1959 | Prout | 362/22 |
| 3,287,599 | 11/1966 | Feinberg et al. | 315/119 X |
| 3,359,523 | 12/1967 | Lou | 338/70 |
| 3,496,422 | 2/1970 | Horowitz | 361/211 |
| 4,216,411 | 8/1980 | Ehret et al. | 315/118 |
| 4,234,819 | 11/1980 | Maxey | 315/119 |
| 4,275,433 | 6/1981 | Caldwell | 362/22 |

*Primary Examiner*—George Harris
*Attorney, Agent, or Firm*—Seidel, Gonda & Goldhammer

[57] ABSTRACT

A thermal switch housing is provided in a recessed lighting fixture for interchangeably accommodating a thermal cut-off switch to protect against overtemperature conditions. The housing allows thermal switches having differing cut-off temperatures to be interchangeably removed and inserted to adjust for variations in fixture design, such as the size, shape and materials of construction.

16 Claims, 4 Drawing Figures

FIG. 1
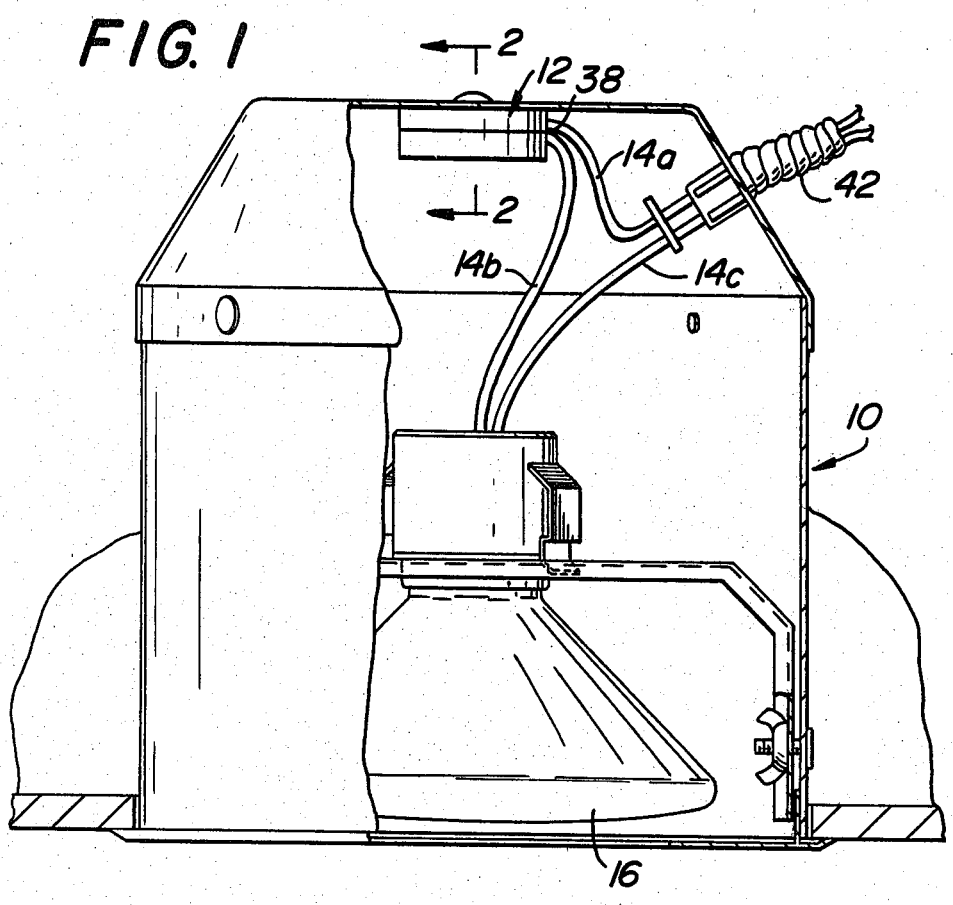
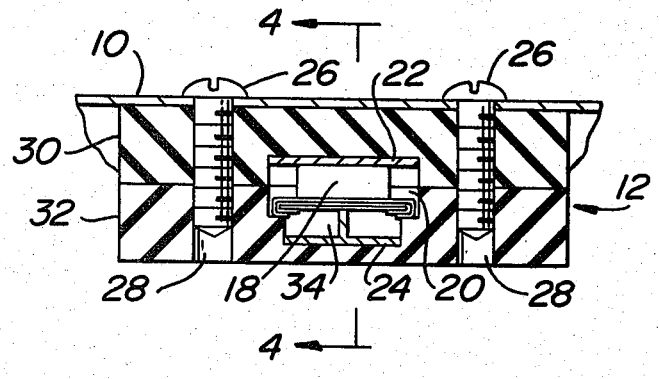
FIG. 2

THERMAL SWITCH HOUSING

BACKGROUND OF THE INVENTION

This invention relates to a thermal switch housing, and more specifically to a thermal switch housing which is designed to be used in a recessed lighting fixture.

Recessed lighting fixtures for incandescent lamps, wherein the housing of the fixture fits through a hole in the ceiling or a wall of a room, are well known in the art. These fixtures are often desirable because, when they are properly mounted, they are flush with the surface of the ceiling or wall, and are unobtrusive. However, one of the dangers with this type of fixture is that heat generated by the lamp accumulates inside the housing and often cannot escape. The temperature of the housing can become exceedingly high and create a potential electrical or fire hazard.

It is proposed to overcome this potential hazard by installing a thermal switch inside the recessed lighting fixture. It is well known in the art to use thermal switches to avoid overtemperature conditions in electrical circuits. However, generally speaking, thermal switches have a fixed cut-off temperature which cannot be altered. Therefore, when a thermal cut-off switch is employed in an electric circuit, the cut-off temperature cannot be altered without changing the switch.

As applied to recessed lighting fixtures, the use of a thermal switch to avoid overtemperature conditions presents a particular problem because the critical overtemperature value is a function of the size, shape, surface area, volume, and materials of construction of the fixtures.

It is therefore desirable to provide an apparatus for interchangeably accommodating a thermal cut-off switch inside a recessed lighting fixture so that thermal switches having different cut-off temperatures can be interchangeably installed into the fixture to meet particular design conditions.

SUMMARY OF THE INVENTION

The present invention consists of a housing which mounts on the interior of a recessed lighting fixture. The housing contains a channel, an access opening and a pair of electric contacts adapted to receive a thermal cut-off switch. The access opening allows the thermal cut-off switch to be inserted into or removed from the housing and thus provides a very high degree of flexibility with respect to the interchangeability of thermal switches. The housing contains means for electrically connecting the apparatus between one of the supply wires to the lamp such that the power supply to the lamp will be interrupted if the temperature inside the fixture rises above the cut-off temperature of the thermal switch.

The housing is constructed of a material which is an electrical insulator, which is not affected by high temperatures and which is a good conductor of heat.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a perspective view of a recessed lighting fixture having a thermal switch housing contained therein.

FIG. 2 is a sectional view taken along line 2—2 of FIG. 1 and illustrates the cooperation of the thermal switch and the housing.

DETAILED DESCRIPTION OF THE INVENTION

Figure 3:
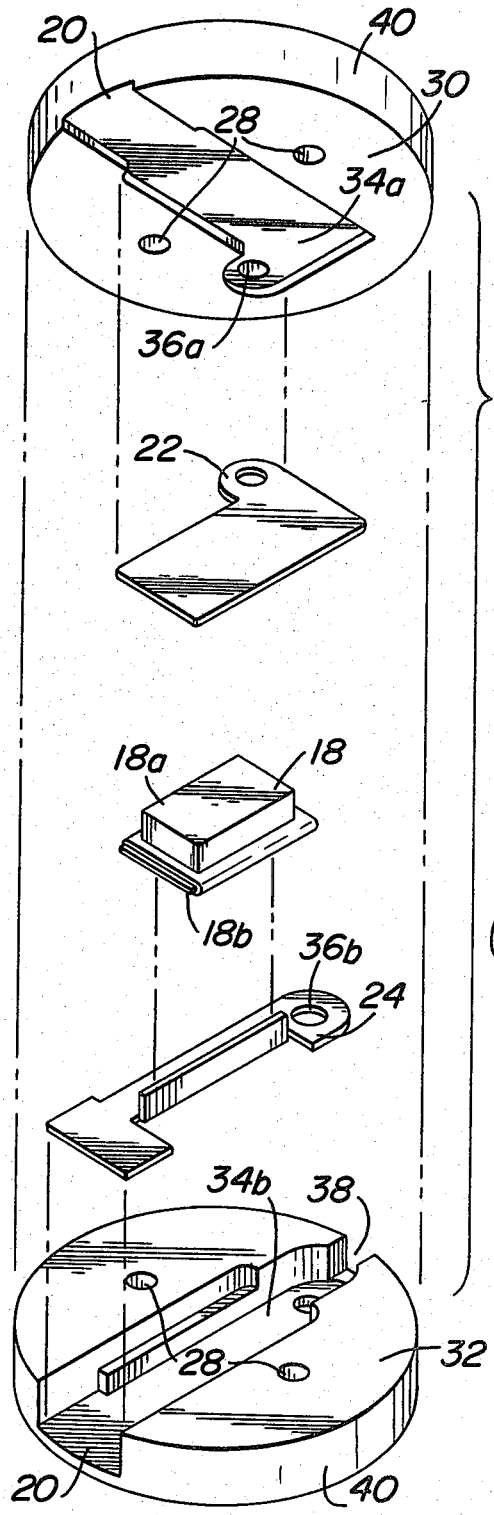
FIG. 3 is an exploded view of the thermal switch housing showing the separated parts of the same, and also illustrating the cooperation among the various parts thereof.

With reference to the drawings, wherein like numerals indicate like elements, in FIG. 1 there is shown a recessed lighting fixture 10 having an incandescent lamp 16 located therein. Power is supplied to the lighting fixture by cable 42 which carries electrical conductors **14*a* and 14*c*. Located interiorly at the top of the fixture 10 is a thermal switch housing 12. Electrical conductor 14*a*, which is one of the power supply lines contained in cable 42, enters the housing 12 by means of an opening 38. As will be explained subsequently, conductor 14*b* completes the circuit to the lamp 16**.

As can be seen in FIG. 2, the housing 12 has a channel 34 disposed therein. A first access opening 20 provides a means wherein thermal switch 18 may be inserted into the housing. Electrical contacts 22 and 24 are arranged within the housing 12, and are disposed about the channel 34, such that the terminals of thermal switch 18 conductively engage with electrical contacts 22 and 24 when the thermal switch 18 is inserted through access opening 20.

Figure 4:
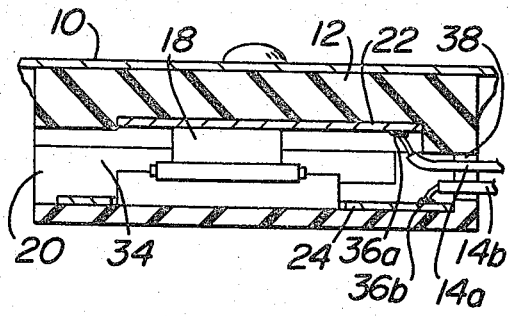
FIG. 4 is a sectional view taken along 4—4 in FIG. 2.

Referring now to FIG. 4, thermal switch 18 is shown in its position of rest within channel 34. The upper terminal of switch 18 conductively engages with electrical contact 22, and the lower terminal of thermal switch 18 conductively engages with contact 24. Electrical conductors **14*a* and 14*b* enter housing 12 by means of a second access opening 38. Conductors 14*a* and 14*b* are conductively affixed to contacts 22 and 24 at points 36*a* and 36*b* respectively. In this manner, it can be seen that when thermal switch 18 has been inserted, an electrically conductive path is established through conductors 14*a* and 14*b***.

As seen in FIG. 3, one embodiment of the invention consists of a cylindrical housing having an upper half 30 and a lower half 32. Upper half 30 and lower half 32 cooperatively mate to form housing 12 and are maintained in cooperative engagement by screws 26 which are adapted to fit into interiorly threaded screw holes 28. Screws 26 also provide a means for affixing housing 12 to the top of fixture 10.

FIG. 3 illustrates that channel 34 accommodates switch 18 and contacts 22 and 24. Contact 22 is accomodated by channel **34*a* and contact 24 is accomodated by channel 34*b*. Channel 34 opens through opposite facing walls or sides of housing 12 to form access openings 20 and 38. Channel 34 is disposed along a line defining the diameter of cylindrical housing 12 and contacts 22 and 24 are diametrically disposed along said channel 34**.

Due to the design of thermal switch 18, upper contact 22 contains a greater conductive surface area than contact 24. When thermal switch 18 is inserted into housing 12, the upper portion **18*a* of thermal switch 18** conductively engages with contact 22, and the lower portion 18*b* conductively engages with contact 24.

The housing should be constructed of a material which is an electrical insulator. Furthermore, a material which can withstand the high temperatures generated by the incandescent lamp 16, but which is also a good conductor of heat, should be selected. A material such as BAKELITE is preferred. However, a hardwood will suffice.

The thermal switch 18 can be one of the type manufactured by Texas Instruments Incorporated and sold under the trade name KLIXON. These switches are miniature in size and various cut-off temperatures can be selected.

The thermal switch 18 has an open status and a closed status, such that when the switch 18 is in its closed status, an electrically conductive path is defined through surfaces 18*a* and 18*b*. When switch 18 is in its open position, the conductive path is disrupted. The switch 18 will be in its closed status when the surrounding temperature is below the cut-off temperature of the particular switch which has been selected. However, when the surrounding temperature of the switch increases above the cut-off temperature, the conductive path between surfaces 18*a* and 18*b* is interrupted.

From the aforementioned, it can be seen that this invention provides protection against overtemperature conditions. If the interior temperature of fixture 10 should increase above the cut-off temperature of thermal switch 18, thermal switch 18 assumes an open status thereby disrupting the supply of power to the lamp 16. When the interior temperature of fixture 10 falls below the cut-off point of the switch, it reverts to its closed status thereby restoring power to the lamp 16.

It can be seen therefore that housing 12, and its associated components as described herein, provides a unique protection apparatus, while preserving the flexibility available from various sizes, shapes, and construction materials of various recessed lighting fixtures. The housing 12 may be a standard item which may be installed in all recessed lighting fixtures, regardless of size, shape or construction materials. When the fixture is sold, the appropriate switch 18 may be selected and easily installed into housing 12 at the time that the fixture is installed. In this manner, soldering, wire nuts, crimp lugs, or the like, are not required to install the thermal switch. If the switch should become defective, or a different cut-off temperature is required, removal and re-installation may be quickly and easily effected.

The present invention may be embodied in other specific forms without departing from the spirit or essential attributes thereof and, accordingly, reference should be made to the appended claims, rather than to the foregoing specification, as indicating the scope of the invention.

I claim:

1. An apparatus for interchangeably accommodating a thermal switch comprising:

(a) a housing;

(b) a channel disposed within said housing adapted to accommodate a thermal switch having an open or closed status, wherein said channel extends through a side of said housing to define a first access opening;

(c) a pair of electrical contacts disposed within said housing and arranged along said channel to provide an electrical connection between said electrical contacts and terminals of said thermal switch; and (d) means for conductively connecting a pair of external electrical conductors to said electrical contacts wherein said thermal switch is interchangeably insertable through said first access opening into said channel such that an electrical path is established through said external electrical conductors when said thermal switch has been inserted and is in said closed status.

2. The apparatus according to claim 1 wherein said channel extends through a side of said housing which is opposite to said first access opening to define a second access opening.

3. The apparatus according to claim 2 wherein said means for conductively connecting a pair of external conductors to said electrical contacts comprises a pair of wires which enter said housing through said second access opening and are fixedly and conductively secured to said electrical contacts.

4. The apparatus according to claim 3 wherein said housing is comprised of a first half and a second half wherein said halves cooperatively engage to form said housing and means for maintaining said halves in cooperative engagement.

5. The apparatus according to claim 4 wherein said means for maintaining said halves in cooperative engagement comprises a plurality of cooperatively aligned openings defining holes, said holes being interiorly threaded to receive screws to maintain said halves in engagement.

6. The appartus according to claim 5 wherein each of said halves contains one of said electrical contacts.

7. The apparatus according to claim 6 wherein said housing is cylindrical.

8. The apparatus according to claim 7 wherein said channel is disposed along a line defining the diameter of said cylinder and wherein said first and second access openings are disposed in opposite facing walls of said cylinder.

9. The apparatus according to claim 8 wherein said pair of electrical contacts are diametrically disposed about said channel.

10. The apparatus according to claim 9 wherein one of said electrical contacts has contains a greater contacting surface area than the other of said pair of contacts.

11. An apparatus for interchangeably accommodating a thermal switch comprising:

(a) a cylindrical housing;

(b) a channel disposed within said housing along a line defining the diameter of said cylindrical housing adapted to accommodate a thermal switch having an open or closed status, wherein said channel extends through opposite facing walls of said cylindrical housing to define first and second access openings;

(c) a pair of electrical contacts disposed within said housing and diametrically disposed about said channel; and (d) means for connecting a pair of external electrical conductors to said electrical contacts wherein said thermal switch is interchangeably insertable through said first access opening into said channel and said external conductors enter through said second access opening and are fixedly and conductively secured to said electrical contacts such that an electric path is established through said external electrical conductors when said thermal switch has been inserted and is in said closed status.

12. The apparatus according to claims 2 or 11 wherein said first access opening is larger than said second access opening.

13. The apparatus according to claim 11 wherein one of said electrical contacts has a greater contacting surface area that the other of said pair of contacts.

14. The apparatus according to claim 13 wherein said housing is comprised of a first half and a second half wherein said halves cooperatively engage to form said housing and means for maintaining said halves in cooperative engagement.

15. The apparatus according to claim 14 wherein said means for maintaining said halves in cooperative engagement comprises a plurality of cooperatively aligned openings defining holes, said holes being interiorly threaded to receive screws to maintain said halves in engagement.

16. The apparatus according to claim 15 wherein each of said halves contains one of said electrical contacts.

* * * * *

UNITED STATES PATENT AND TRADEMARK OFFICE

CERTIFICATE OF CORRECTION

PATENT NO. : 4,400,673

DATED : August 23, 1983

INVENTOR(S) : Lester J. Gilman

It is certified that error appears in the above-identified patent and that said Letters Patent is hereby corrected as shown below:

On the title page assignee should read

-- Kidde Consumer Durables Corp. --.

Signed and Sealed this

*Twentieth* Day of *December 1983*

[SEAL]

*Attest:*

GERALD J. MOSSINGHOFF

*Attesting Officer*

*Commissioner of Patents and Trademarks*